US005207562A

United States Patent [19]

Neibrook et al.

[11] Patent Number: 5,207,562

[45] Date of Patent: May 4, 1993

[54] SUBMERSIBLE PUMP WITH HANDLE PROVIDING ELECTRICAL CONNECTION AND OIL PORT

[75] Inventors: Dennis W. Neibrook, Kansas City, Mo.; Tom F. Kruzel, Maple Grove, Minn.

[73] Assignee: The Marley Company, Mission Woods, Kans.

[21] Appl. No.: 876,955

[22] Filed: Apr. 30, 1992

[51] Int. Cl.[5] ..... F04B 21/00

[52] U.S. Cl. ..... 417/234; 417/422; 417/423.3

[58] Field of Search ..... 417/234, 422, 423.3; 310/87

[56] References Cited

U.S. PATENT DOCUMENTS

| | | | |
|---|---|---|---|
| 3,269,322 | 8/1966 | Lotspih | 417/423.3 |
| 4,954,049 | 9/1990 | Armbruster | 417/234 |
| 5,055,000 | 10/1991 | Akhter | 417/423.3 |

*Primary Examiner*—Richard E. Gluck

*Attorney, Agent, or Firm*—Kokjer, Kircher, Bowman & Johnson

[57] ABSTRACT

A submersible pump such as a sump pump or sewage pump has a handle which also serves to provide electrical connections and an oil port. The handle has two barrels which extend through the top of the pump casing and receive nuts which secure the handle on the pump. O-rings are provided beneath flanges on the barrels for sealing purposes. Retainers for the O-rings hold them beneath the flanges. One barrel has electrical terminal pins molded into it. A power cord can be connected with the pins by inserting a plug on the cord into a socket on the barrel. Within the pump casing, the terminal pins are connected with wiring for the motor. An external float switch controls the on and off conditions of the motor. The second barrel provides an oil passage which may be closed by a removable threaded plug.

13 Claims, 1 Drawing Sheet

SUBMERSIBLE PUMP WITH HANDLE PROVIDING ELECTRICAL CONNECTION AND OIL PORT

FIELD OF THE INVENTION

This invention relates generally to pumps and more particularly to a pump having a unique molded handle which provides an oil port and electrical connections between the pump motor and power cord.

BACKGROUND OF THE INVENTION

Sump pumps and sewage pumps are equipped with electric motors which are typically controlled by a float switch responsive to the liquid level in the sump. Electrical wiring must be connected to the motor leads from a power cord and a cord extending to the float switch. It is also necessary to provide for oiling of the pump motor. A handle on the pump is a desirable feature which facilitates lifting and carrying of the pump.

In the past, the handle of the pump has merely served the function of allowing the pump to be lifted and carried. The electrical connections are made separately, and an oil port is normally provided somewhere on the pump casing. Sealing of the pump housing to prevent water from leaking into the pump has created difficulties. Typically, an O-ring groove is incorporated to hold an O-ring which performs the sealing function. Molding of the O-ring groove requires a relatively complicated mold which increases the overall production cost.

SUMMARY OF THE INVENTION

The present invention is directed to an improved pump having a handle which serves the functions of (1) allowing convenient lifting and carrying of the pump, (2) providing electrical connections between the power cord and the motor leads, and (3) providing an oil port for the pump. In addition, the invention features a special O-ring retainer which provides an O-ring groove while at the same time allowing the handle to be molded using an inexpensive two-piece mold.

In accordance with the invention, a plastic molded handle has a hand grip from which two barrels extend through the top of the pump casing. The ends of the barrels are threaded to receive nuts which secure the handle on the pump. One barrel has electrical terminal pins molded to it and projecting into a socket which receives a plug on the end of a detachable power cord. The other ends of the pins connect electrically within the pump casing with wiring for the motor leads and the float switch. The other barrel presents an oil passage which allows the pump to be lubricated.

The barrels have annular flanges which bear against O-rings to provide a seal against the top of the pump casing. Special O-ring retainers extend around the O-rings to maintain them beneath the flanges. The retainers have lips which underlie the edges of the flanges in order to hold the O-rings in the grooves formed by the flanges and the retainers.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
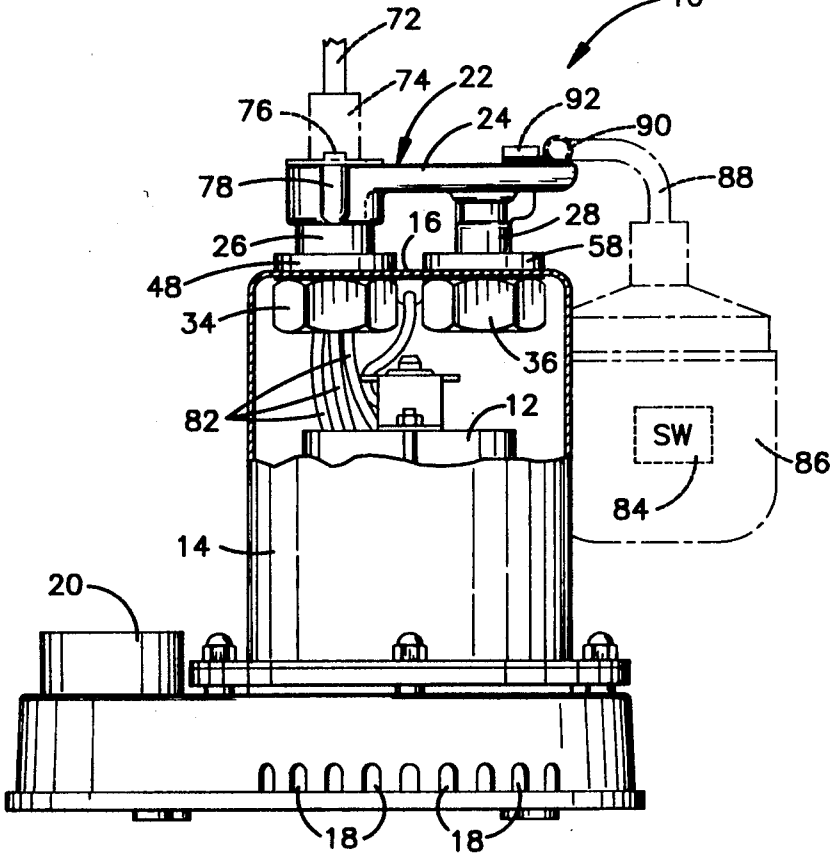
FIG. 1 is a side elevational view of a submersible sump pump constructed according to a preferred embodiment of the present invention, with portions broken away and shown in section for purposes of illustration and with the float and part of the power cord shown in phantom.

Referring now to the drawings in more detail and initially to FIG. 1, numeral 10 generally designates a submersible electric pump which may be a sump pump intended for installation in a sump. The pump 10 has a conventional electric motor 12 which is housed within a cylindrical pump casing 14 having an integral top panel 16. The motor 12 drives the usual impeller (not shown) which operates to draw liquid in through inlet openings 18 formed in the base portion of the pump. Liquid is discharged from the pump through an outlet 20 to which tubing is normally connected for directing the liquid to the desired location.

In accordance with the present invention, the pump is equipped with a special handle which is generally identified by numeral 22 and which is preferably molded in a single integral piece from a suitable hard plastic. The handle 22 has a hand grip 24 which may be grasped by the hand of the user in order to lift and carry the pump 10. Projecting from and integral with the hand grip 24 are a pair of barrels 26 and 28 which extend closely through respective openings 30 and 32 (see FIG. 3) formed in the top panel 16 of the pump casing 14. The lower ends of the barrels 26 and 28 are located within the interior of the pump casing and are threaded to receive nuts 34 and 36. The nuts 34 and 36 may be tightened on the barrels from inside of the casing in order to secure the handle 22 in place on the top panel 16.

Figure 2:
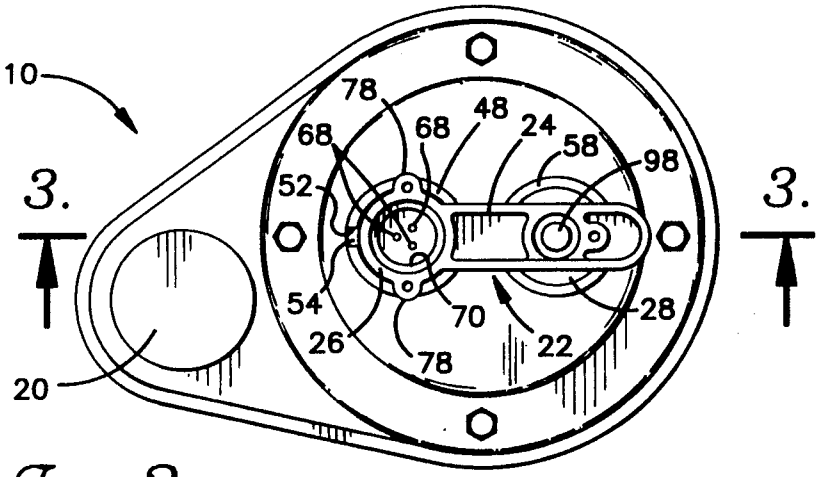
FIG. 2 is a top plan view of the submersible pump shown in FIG. 1, with the detachable power cord and the float removed.
Figure 3:
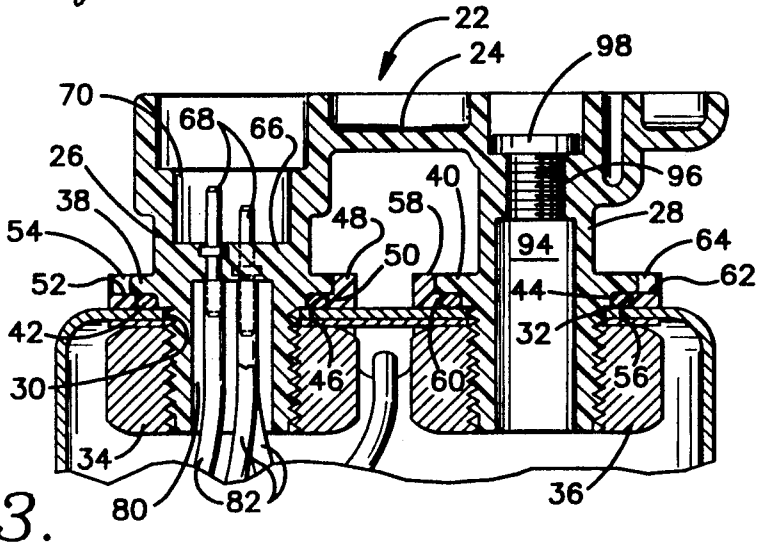
FIG. 3 is a fragmentary sectional view on an enlarged scale taken generally along line 3—3 of FIG. 2 in the direction of the arrows.

With continued reference to FIG. 3 in particular, the barrels 26 and 28 have respective annular flanges 38 and 40 which project outwardly from the barrels. The flanges 38 and 40 bear against respective O-rings 42 and 44 which provide water tight seals around the openings 30 and 32. O-ring 42 is located in a groove 46 which is formed between flange 38 and the top 16 of the pump casing. A retainer ring 48 maintains the O-ring 42 within groove 46 and prevents it from being squeezed out of the groove. The retainer ring 48 is generally annular and extends around the flange 38. The retainer ring 48 has a lip 50 on its lower portion which projects inwardly beneath the peripheral edge of flange 38. The lip 50 provides a ledge on which the flange 38 seats when nut 34 is tightened fully. The O-ring 42 is compressed between flange 38 and top panel 16 when the flange 38 seats on lip 50 so that an effective seal is provided. As best shown in FIGS. 2 and 3, the retainer ring 48 has a notch 52 which closely receives a finger 54 projecting radially from the flange 38 to prevent the retainer ring from turning.

The other O-ring 44 is similarly held in a groove 56 which is formed beneath flange 40 and above the top panel 16 of the pump casing. A retainer ring 58 identical to ring 48 extends around flange 40 and has an inwardly projecting lip 60 on which the peripheral edge portion of flange 40 seats when nut 36 is tightened. The lip 60 assures that the O-ring 44 will be retained in the groove 56 and not be squeezed out of it. The retainer ring 58 has a notch 62 which receives a projecting finger 64 on flange 40 to prevent the retainer ring from turning.

In this manner, the retainer rings 48 and 58 assure that the O-rings 42 and 44 are retained in the O-ring grooves 46 and 56 and effectively seal around openings 30 and 32. The retainer rings 48 and 58 can easily be molded in an inexpensive two-piece mold and thus do not require complicated and expensive molding equipment of the type that is necessary to provide suitable O-ring grooves in the pumps that have been available in the past.

With continued reference to FIG. 3 in particular, barrel 26 is provided with an internal partition 66 which is molded integrally with the handle 22. Three electrical terminal pins 68 are molded into the partition 66, with enlarged collars on the pins being molded into the partition 66 in order to prevent the pins from pulling out of the partition. The top ends of the pins 68 project into a socket 70 which is formed within the top portion of barrel 26. The socket 70 is open at the top. A power cord 72 (FIG. 1) has a plug 74 on one end which may be fitted closely in the socket 70 and includes openings (not shown) into which the pins 68 project when the plug is inserted into the socket 70. The pins 68 then make electrical contact with power conductors within the cord 72. The opposite end of the cord 72 has a conventional plug (not shown) of the type that can be plugged into a wall receptacle. The plug 74 may be secured in the socket 70 by extending screws 76 through lugs on the plug and threading the screws into bosses 78 formed on the outside of the barrel 26.

As best shown in FIG. 3, the lower ends of the pins 68 project into a recess 80 formed in the lower portion of barrel 26. Electrical wiring 82 which includes the leads of motor 12 connects with the pins 68 at a location within the recess 80. The motor 12 is controlled by a conventional float switch 84 (FIG. 1) carried by a float 86. A float cord 88 carries conductor wires which connect with the power cord 72 in a manner to make electrical current available to the motor 12 when the float switch 84 is closed. The cord 88 connects to the power cord by means of a "piggy-back" plug (not shown). When the switch 84 is open, the energizing circuit to the motor 12 is interrupted so that the motor does not operate. The switch 84 is arranged to close when the liquid level in the sump rises to a selected level and to open when the liquid level is reduced by the pump to a lower level. The float switch cord 88 may be held by a clamp 90 which is secured to the end of the handle grip 24 by a screw 92.

The second barrel 28 presents within it an oil passage 94 which leads to the interior of the pump casing and permits the pump motor 12 to be oiled. An oil port 96 in barrel 28 provides access to the oil passage 94 and is normally closed by a threaded plug 98. The plug 98 may be removed from the port 96 so that oil can be applied to the port and then through the oil passage 94 to the interior of the pump casing.

The handle 22 not only provides a convenient hand grip 24 which facilitates lifting and carrying of the pump 10, but it also provides the oil passage 94 and electrical connections for the motor 12 through the terminal pins 68. Consequently, it is unnecessary to provide a separate oil port and to provide electrical connections in a terminal box or elsewhere on the pump.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. In a pump having a pump casing, an electric motor in the casing for driving the pump, and lead wires for the motor, the improvement comprising:

a handle adapted to be grasped by the hand, said handle presenting a socket for receiving a plug on a power cord which is adapted for connection with an electrical power source;

a plurality of electrical terminal pins secured to said handle and projecting into said socket at locations to electrically connect with the plug upon application of the plug to said socket; and means for connecting said handle to said casing with the handle accessible for grasping to lift and carry the pump and with the lead wires electrically connected to said terminal pins.

2. The improvement of claim 1, wherein:

the pump casing has a top presenting an opening therein;

said handle includes a barrel extensible through said opening and presenting said socket therein; and said connecting means is effective to secure the handle to said casing top with said barrel extending through the opening.

3. The improvement of claim 2, wherein:

said handle and barrel are molded plastic formed integrally with one another; and said terminal pins are metal pins molded to the barrel.

4. The improvement of claim 3, including a partition in the barrel adjacent to said socket, said pins being molded to said partition.

5. The improvement of claim 2, including:

a generally annular flange on said barrel projecting outwardly therefrom;

a seal ring extending around the barrel and interposed between said flange and the top of the pump casing to effect a water tight seal when the handle is attached to the pump casing; and a retainer ring for the seal ring extending around said flange and having a lip portion underlying the flange at a location outwardly of said seal ring to retain the seal ring beneath the flange.

6. The improvement of claim 2, including:

a second opening in the top of the pump casing;

a second barrel on the handle extensible through said second opening, said second barrel presenting an oil port therethrough leading to the interior of the pump casing; and a removable plug for closing said oil port.

7. The improvement of claim 6, including:

a generally annular flange on each barrel projecting outwardly therefrom;

a seal ring for each barrel extending around the barrel and interposed between the flange thereon and the top of the pump casing to effect a water tight seal; and a retainer ring extending around each flange, each retainer ring having a lip portion underlying the corresponding flange at a location outwardly of the corresponding seal ring to retain the seal rings beneath the flanges.

8. In a pump having a pump casing, an electric motor in the casing for driving the pump, and lead wires for the motor, the improvement comprising:

a handle adapted to be grasped by the hand;

a plurality of electrical terminals in said handle at a location accessible for connection with an electrical power source;

means for connecting said handle to said casing with the handle accessible for grasping to lift and carry the pump and with the lead wires electrically connected to said terminals;

oil port means in said handle providing an oil passage therethrough to the interior of the casing when the handle is attached to the casing; and removable plug means for closing said port means.

9. The improvement of claim 8, wherein:

the pump casing has a top presenting an opening therein;

said handle includes a barrel extensible through said opening;

said connecting means is effective to secure the handle to said casing top with said barrel extending through the opening; ; and said oil passage extends through said barrel.

10. The improvement of claim 9, including:

a generally annular flange on said barrel projecting outwardly therefrom;

a seal ring extending around the barrel and interposed between said flange and the top of the pump casing to effect a water tight seal when the handle is attached to the pump casing; and a retainer ring for the seal ring extending around said flange and having a lip portion underlying the flange at a location outwardly of said seal ring to retain the seal ring beneath the flange.

11. The improvement of claim 9, including:

a second opening in the top of the pump casing; and a second barrel on the handle extensible through said second opening, said second barrel carrying said electrical terminals.

12. The improvement of claim 11, including:

a generally annular flange on each barrel projecting outwardly therefrom;

a seal ring for each barrel extending around the barrel and interposed between the flange thereon and the top of the pump casing to effect a water tight seal; and a retainer ring extending around each flange, each retainer ring having a lip portion underlying the corresponding flange at a location outwardly of the corresponding seal ring to retain the seal rings beneath the flanges.

13. In a submersible pump having a pump casing presenting a top with an opening therein and a electric motor in the casing for driving the pump, the improvement comprising:

a handle adapted to be grasped by the hand, said handle having a barrel projecting therefrom;

means for attaching said handle to the casing with said barrel extending through the opening and with the handle accessible for grasping to lift and carry the pump;

electrical conductor means extending through said barrel to supply electrical power to the motor;

a generally annular flange on said barrel projecting outwardly therefrom;

a seal ring extending around the barrel and interposed between said flange and the top of the pump casing to effect a water tight seal when the handle is attached to the pump casing; and a retainer ring for the seal ring extending around said flange and having a lip portion underlying the flange at a location outwardly of said seal ring to retain the seal ring beneath the flange.

* * * * *